US005279276A

United States Patent [19]

Nagel et al.

[11] Patent Number: 5,279,276

[45] Date of Patent: Jan. 18, 1994

[54] SLINGSHOT AND PROJECTILE THEREFOR

[76] Inventors: Dietmar Nagel, 147 South Rd., Chester, N.J. 07930; Craig P. Nadel, 201 Wingate Rd., Parsippany, N.J. 07054

[21] Appl. No.: 969,003

[22] Filed: Oct. 30, 1992

[51] Int. Cl.[5] ..... F41B 7/00

[52] U.S. Cl. ..... 124/20.1; 124/20.2

[58] Field of Search ..... 124/18, 20.1, 20.2, 124/20.3

[56] References Cited

U.S. PATENT DOCUMENTS

| | | | |
|---|---|---|---|
| 101,382 | 3/1870 | Robinson | 124/18 |
| 102,594 | 5/1870 | Robinson | 124/18 |
| 219,180 | 9/1879 | Shipman | 124/18 |
| 1,626,892 | 5/1927 | Tidwell | 124/18 |
| 2,708,429 | 5/1955 | Tufts | 124/18 X |
| 3,865,094 | 2/1975 | Sweeney | 124/20.1 |

*Primary Examiner*—Randolph A. Reese
*Assistant Examiner*—John Ricci
*Attorney, Agent, or Firm*—Cohen, Pontani, Lieberman, Pavane

[57] ABSTRACT

A slingshot is operable for propelling a projectile toward a target. The projectile is formed as a body from which a pair of elastic members outwardly and nondetachably extend. The slingshot includes a yoke having first and second substantially upwardly and outwardly extending prongs and a user-graspable handgrip depending downwardly. Each of the prongs carries one of a pair of confrontingly opposed posts that extend outwardly from the prong and on the periphery of which a slot is defined. In use, the elastic members are releasably received in the respective post slots and the projectile is grasped by the user and drawn rearwardly to stretch the elastic members against their elastic urgency. When the projectile is then released, the elastic members contract that propel the projectile toward the target. As the projectile passes between and beyond the yoke prongs, the elastic members are released from the post slots and travel with the projectile body toward the target.

33 Claims, 4 Drawing Sheets

SLINGSHOT AND PROJECTILE THEREFOR

FIELD OF THE INVENTION

The present invention relates generally to a slingshot device for propelling a projectile toward a target and, more particularly, to such a device in which the elastic member utilized for propelling the projectile is integral with the projectile.

BACKGROUND OF THE INVENTION

The manufacture and use of slingshots are ancient arts. The typical design of a conventional slingshot includes a user-graspable handle from which a pair of upwardly extending arms extend, the entire structure having the general appearance of an enlarged letter "Y". To the upper tips or ends of the arms is attached an elastic material having, at its center, means for holding or retaining an object to be propelled. In operation, a user or shooter grasps the handle with one hand and pulls back on the elastic material by holding the object in the retaining means with the other hand to thereby displace the object in a direction substantially opposite that of the target. As the retaining means is thus rearwardly displaced, the elastic material is placed in tension, storing potential energy in the elastic material. When the retaining means is released, and the object is propelled toward the target under the urgency of the elastic material as the same contracts from its stretched position and thereby releases the stored potential energy as kinetic energy.

Since the elastic material is an integral part and element of the slingshot, the forward thrust of the elastic material through the nip defined between the two arms after release of the projectile is typically followed by a violent downward snap or recoil which can easily bruise the fingers of the shooter or otherwise inflict pain and/or injury, thereby presenting a safety hazard to the user. Moreover, since the object or projectile is often only loosely held, if at all, in the retaining means, there is a tendency for the object to unintendedly positionally move or shift prior to or in the course of its release and forwardly-driven motion. Such positional displacement may disadvantageously affect the trajectory or direction along which the projectile is propelled—potentially resulting in injury to bystanders or others in the areas of the user and/or of the target—or, in extreme cases, may cause the projectile to strike or impact the slingshot itself and/or the hands or limbs of the user and thereby be diverted into injurious contact with the user or innocent bystanders. In addition, failure to place and maintain the object in the exact center of the elastic member or retaining means will cause an uneven distribution of propelling forces to be imparted to the projectile and be wasteful of effort in that not all of the stored potential energy in the elastic material will be transferred to the object, thus limiting its range.

Various attempts to improve the safety, accuracy and range of slingshot-type devices are evident in the prior art.

For example, U.S. Pat. No. 3,875,923 to Horel discloses a slingshot that is provided with an arm brace so that the slingshot can be held with enhanced steadiness over like devices known prior thereto. The slingshot includes an extension disposed at the top of the hand grip for protecting the fingers from the elastic member after its object-propelling release. The Horel device nevertheless suffers from many of the same drawbacks as prior art slingshots. In particular, since the elastic member is part of the slingshot and the object is placed in a retaining means, the Horel slingshot does nothing to improve the accuracy with which an object is propelled or the various other problems inherent in prior art devices with an unintendedly shifting or initially uncentered projectile.

U.S. Pat. No. 2,708,429 to Tufts is directed to an elastic band-type gun in which the projectile is a ball having a single elastic member secured thereto. A loop at the free end of the elastic band is secured to the end of the gun; the ball is pulled back, and elastic band is stretched, until the ball is seated in a recess of the gun where it is retained by a lever. Upon pulling of the trigger, the lever is lifted thereby freeing the ball for forward movement as the elastic band returns to its untensioned state. The Tufts gun is a relatively complicated mechanism and is therefore correspondingly expensive to manufacture. It also suffers many of the same drawbacks noted above with respect to prior art slingshots. Specifically, the single elastic member on the projectile causes it to be propelled with only limited control of direction and trajectory. In addition, the Tufts device has but a limited range given the presence of only a single elastic member for propelling the trajectory toward a target.

OBJECTS OF THE INVENTION

It is accordingly the primary object of the present invention to provide a slingshot-type device which overcomes the above-mentioned drawbacks and deficiencies of the prior art.

It is a further object of the invention to provide a slingshot which will not cause injury to the user's hand or to innocent bystanders when the slingshot is operated to propel the object toward a target.

It is another object of the invention to provide a slingshot which, although of relatively simple and correspondingly reliable construction, is readily operable to propel an object toward a target with unusual accuracy.

It is a still further object of the invention to provide a slingshot having an enhanced range with respect to prior art devices.

It is yet another object of the invention to provide a slingshot of particularly simple construction using a minimum number of parts, that may be manufactured using readily available materials and techniques and offered commercially at a competitive price point, and which is inherently reliable and resists damage even when roughly handled.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims.

SUMMARY OF THE INVENTION

In the currently preferred embodiment of the present invention, a slingshot device is configured and constructed for propelling an object or projectile having a body and integral first and second elastic members toward a target. The slingshot is formed of a yoke having first and second substantially upwardly extending prongs or arms and a user-graspable handgrip depending therefrom. Each of the first and second prongs carries an integral member or post extending outwardly from the prong and in confronting relation to the other said post for releasable engagement with a respective one of the first and second elastic members of the object. A slot or groove defined in each post receives one of the elastic members and is open in the direction of the target so that, as the projectile body is grasped by the user and displaced rearwardly—i.e. in a direction opposite the target—the elastic members are retained in the grooves and are stretched or extended to store potential energy. When the grasped projectile is then released by the user, the stored potential energy is converted to kinetic energy and the projectile is propelled toward the target under the urgency of the stretched or extended elastic members. As the projectile is propelled through the yoke and beyond the slingshot, the elastic members are withdrawn and released from the open grooves and travel with the projectile body toward the target.

In accordance with another aspect of the present invention, the substantially "Y"-shaped slingshot further includes an arm brace extending rearwardly—i.e. away from the target—from the yoke and through which a portion of the user's arm is inserted before grasping of the slingshot handgrip. The arm brace provides enhanced steadiness and stability in the use of the inventive apparatus. The handgrip and depending yoke are preferably pivotably moveable relative to the arm brace to permit ready adjustment of the direction in which propelled movement of the projectile is intended or desired.

BRIEF DESCRIPTION OF THE DRAWINGS

In the drawings, wherein like reference characters denote similar elements throughout the several views.

DETAILED DESCRIPTION OF THE PREFERRED EMBODIMENTS

The present invention is directed to a slingshot device for selectively propelling an object or projectile in a predetermined and user-controllable direction toward a target. In its broadest sense, the invention provides the combination of a projectile and a hand-held hurling device, in the general form of a slingshot, wherein the hurling device itself includes no elastic means or members for propelling the projectile; instead, it is the projectile that nondetachably incorporates one or more elastic members for releasable engagement with the slingshot and which supplies the elastic energy for hurling the projectile toward the target. Thus, the projectile is formed as a body having a pair of elastic members or bands affixed to and extending outwardly from the body. The hurling or slingshot device, in the conventional "Y"-shaped configuration, carries a pair of opposed posts or the like extending in mutually confronting relation from its respective upwardly-oriented arms or prongs. Each post includes a slot or groove defined in the post and oriented so that, when the slingshot is positioned for propelling a projectile toward a target, the slots are open in the direction of the target. The elastic bands are releasably receivable in the slots and substantially about the posts and, after the user-grasped projectile is rearwardly (i.e. away from the target) displaced against the elastic urgency of the elastic bands and then released, the projectile is propelled toward the target, the elastic members disengaging from the slots and posts as the projectile passes through the slingshot arms on its way to the target.

Figure 1:
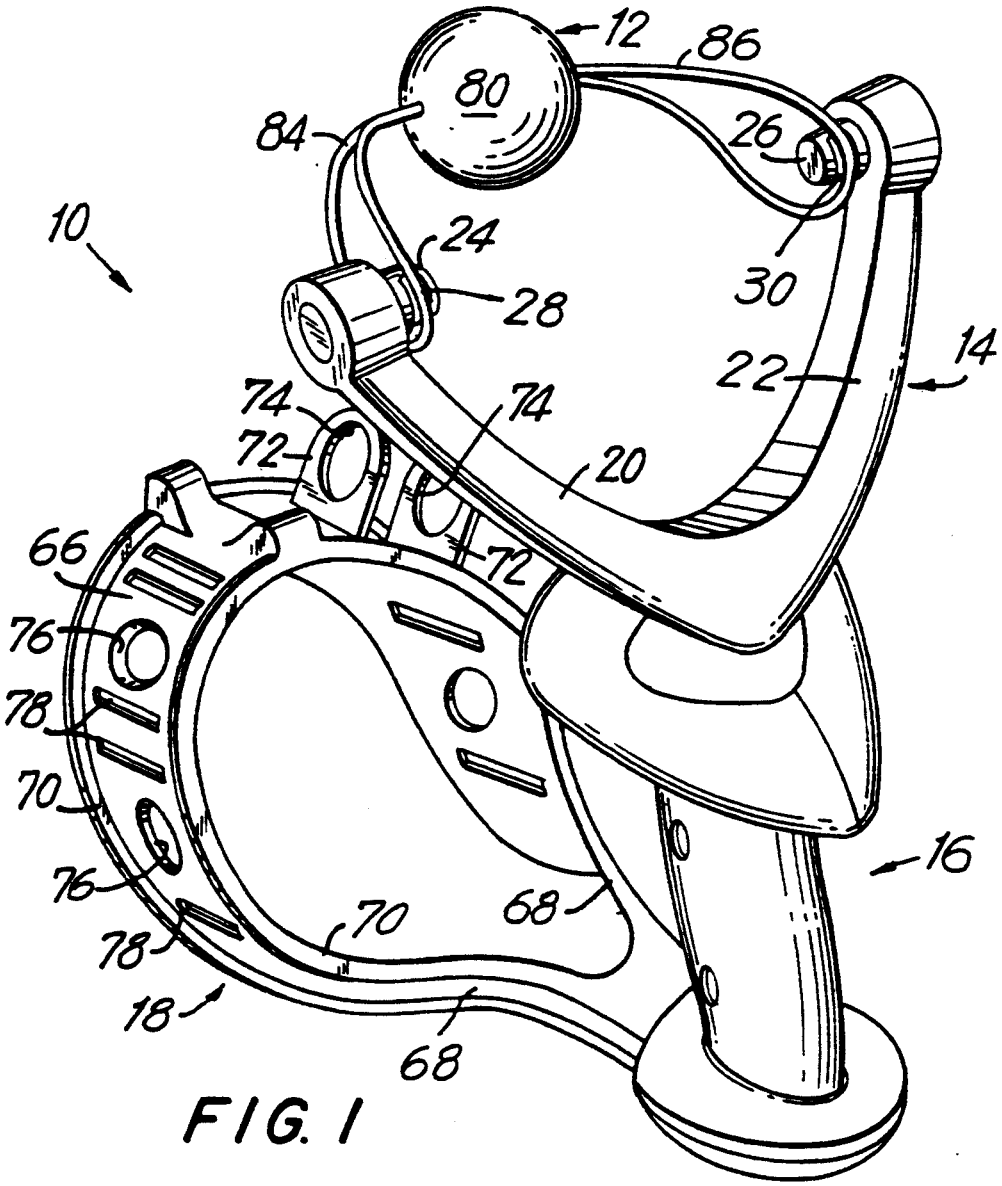
FIG. 1 is an elevated front perspective view of a first embodiment of a slingshot device constructed in accordance with the teachings of the present invention.
Figure 2:
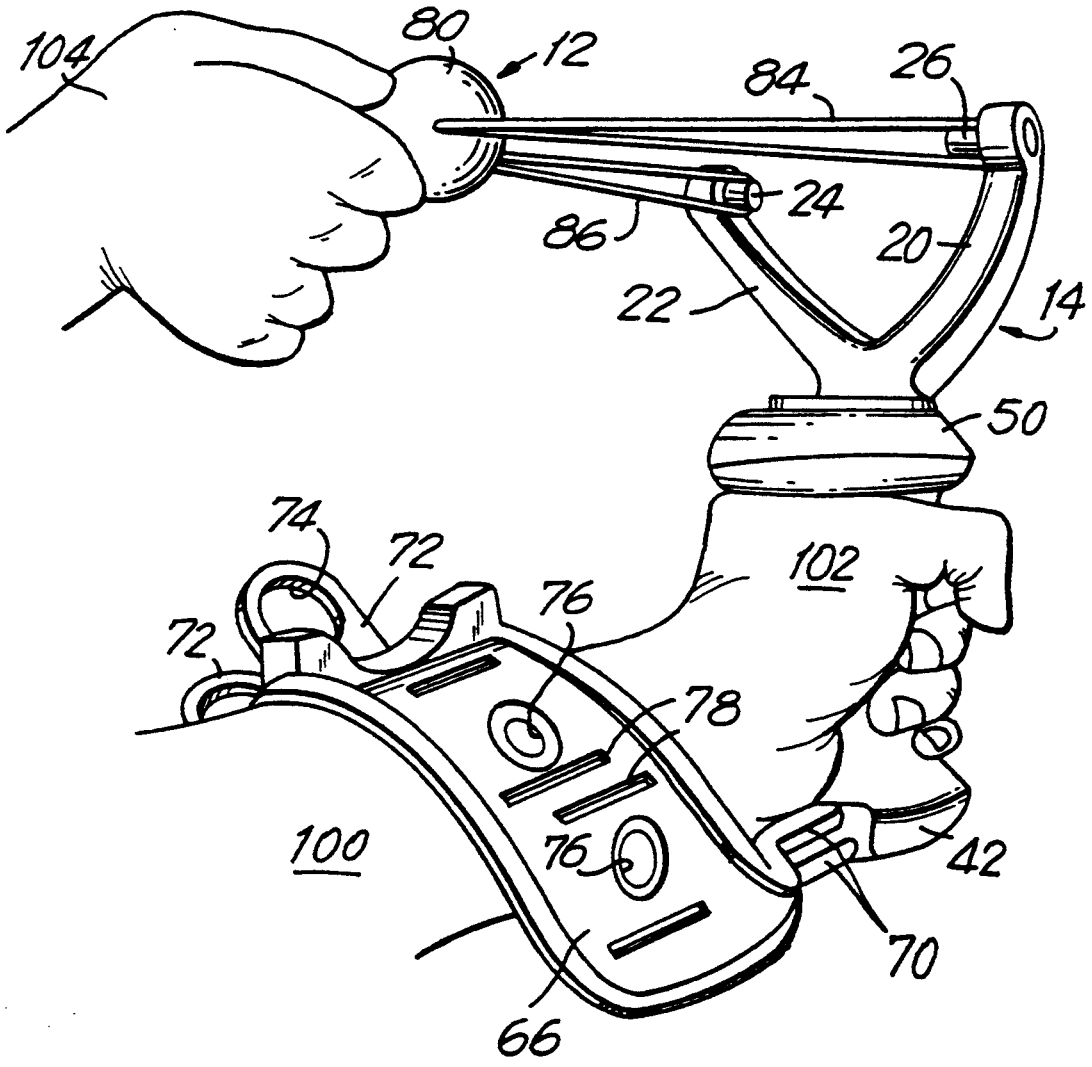
FIG. 2 is an elevated rear perspective view of the FIG. 1 embodiment of the invention showing a typical contemplated use thereof.
Figure 3:
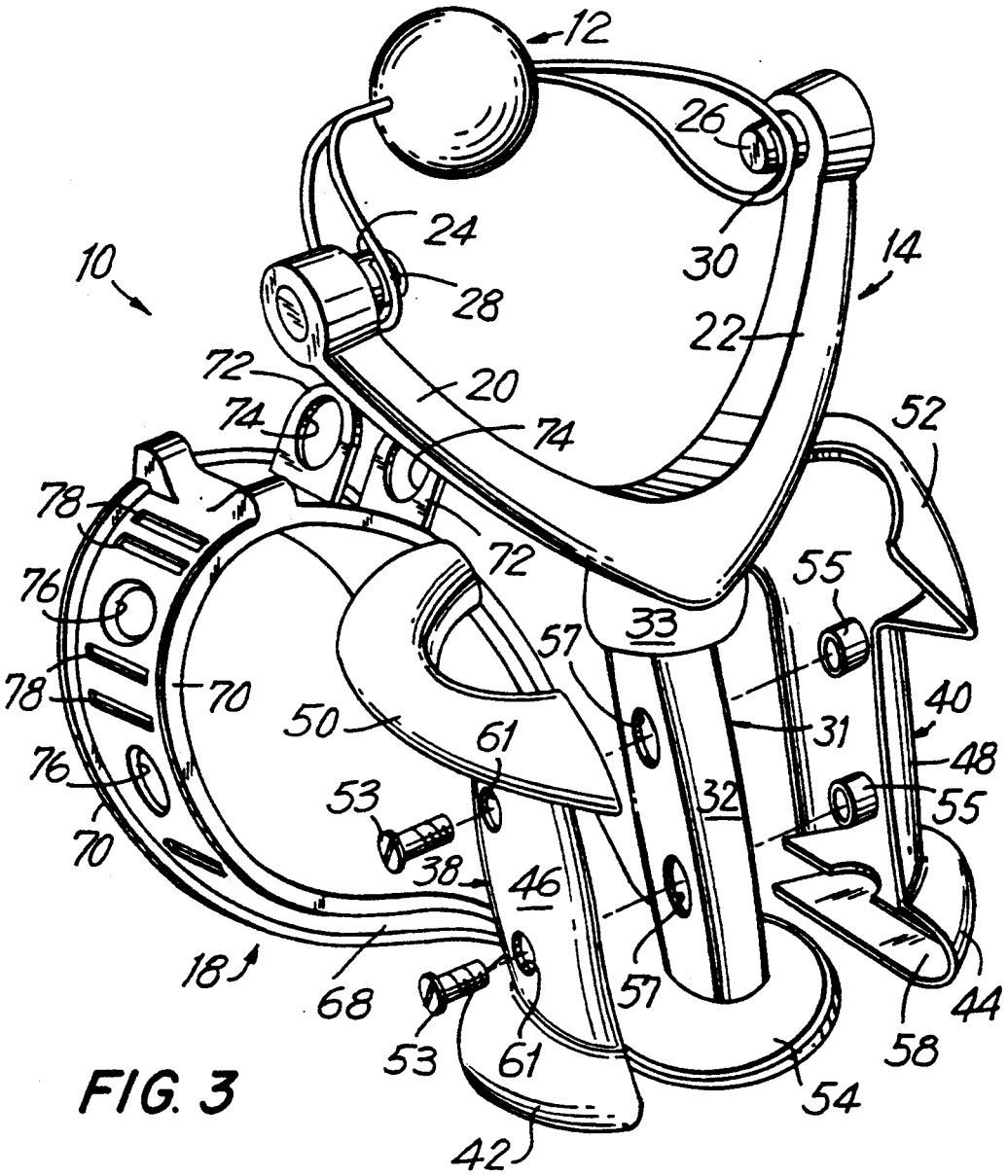
FIG. 3 is an elevated front perspective, partially exploded view of the FIG. 1 embodiment of the invention.
Figure 4:
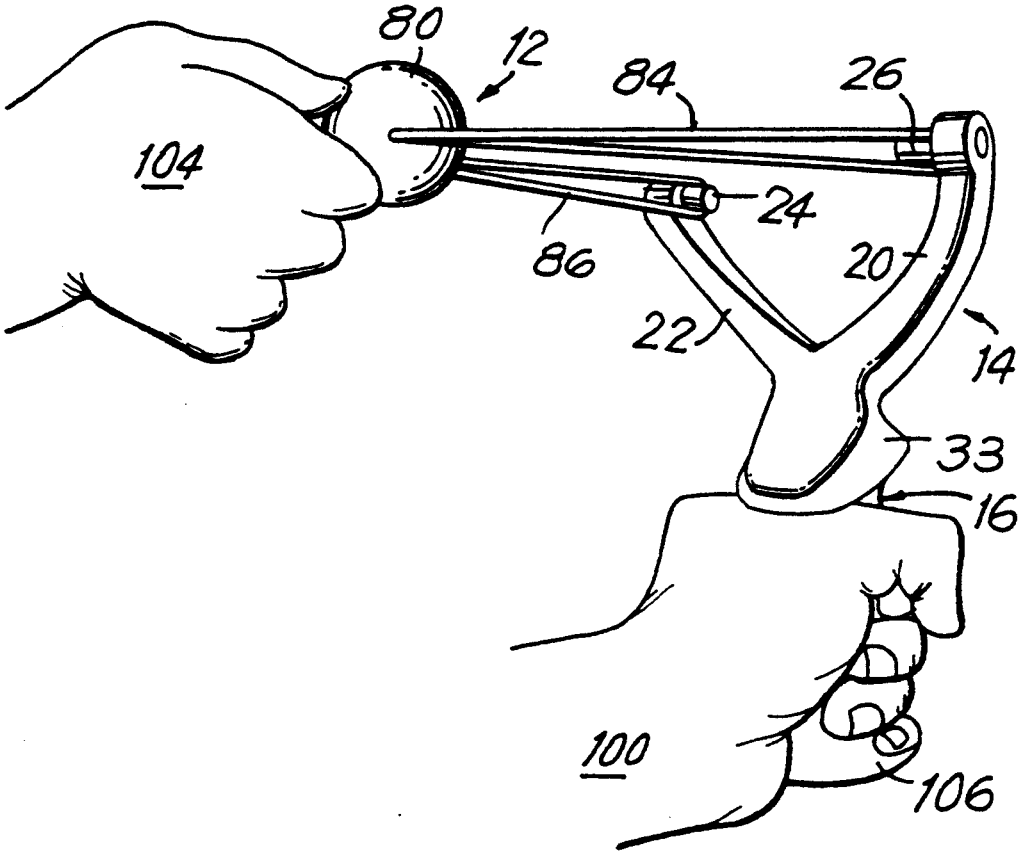
FIG. 4 is a rear perspective view of a second embodiment of a slingshot device constructed in accordance with the invention and showing a typical contemplated use thereof.

The present invention will initially be further described, by way of currently preferred example, with respect to the slingshot 10 that is depicted in FIGS. 1 to 3. A second embodiment of a slingshot 10' also constructed in accordance with the invention is illustrated in FIG. 4, and several alternate projectile constructions are shown, by way of example, in FIGS. 5A and 5B. As will become apparent, other and additional modifications and constructions of the slingshot and projectile are also contemplated and should be understood as being within the intended scope of the invention.

With particular reference to FIGS. 1 and 3 of the drawings, a slingshot 10 operable or usable for propelling an object or projectile 12 toward a target (not shown) includes a yoke 14, a grip 16, and an arm brace 18. The yoke 14 is formed as a pair of arms or prongs 20, 22 that extend upwardly and outwardly from an elongated base or lower member 31 (FIG. 3) to form a substantially Y-shaped structure.

In the embodiment depicted in FIGS. 1 to 3, the prongs 20, 22 have a graduated, generally rectangular cross-section with rounded edges, and the angle formed by the nip defined between the prongs 20, 22 is in the range of approximately 45° to 90°. Each prong carries, preferably at or proximate its upper end or extension, a respective extension member 24, 26 having, by way of example, the general form of a post or elongated boss. Each post 24, 26 has a substantially circular or arcuate cross-sectional configuration and includes a respective slot or groove 28, 30 defined in its peripheral surface. The slots 28, 30 are arranged and oriented on the posts so that, when the slingshot 10 is positioned by the user for propelling a projectile 12 toward a target, the slots are open in the direction of the target or, in other words, face the target. Put still another way, with the slingshot positioned so that the intended target is in "front" of the slingshot, the slots are disposed on the "front" of the slingshot. In addition, in the embodiments of the invention herein disclosed each slot 28, 30 is oriented so as to extend, with the slingshot positioned for use, substantially vertically along the periphery of the respective post 24, 26.

As should also be apparent in the drawings, the posts 24, 26 extend from the respective prongs 20, 22 of the herein-disclosed slingshot 10 in mutually confronting opposition such that each post extends outwardly from its respective prong generally toward the opposite or other prong of the yoke 14. Those skilled in the art will nevertheless recognize that some modification of this aspect of the inventive slingshot structure may be incorporated in the device while maintaining its advantageous physical and operating characteristics. It is also presently preferred that the prongs 20, 22, lower member 31, and posts 24, 26 be unitarily fabricated to form a one-piece unit and thereby enhance the structural integrity and reliability of the slingshot while minimizing manufacturing and assembly costs. In furtherance of this end, the unitary yoke 14 and base 31 may be formed of a lightweight, inelastic, readily-formable material of reasonably high strength such, for example, as molded plastic or the like.

The base or lower member 31, as shown in FIG. 3, includes an elongated neck portion 32 and a positioning or capture nodule 33 located at the top of the neck and, more particular, at its joinder to the prongs 20, 22. The nodule 33 has a generally circular cross-section of a diameter that gradually increases in a direction from the prongs 20, 22 to the neck portion 32. The elongated neck portion 32 has a substantially rectangular cross-section whose width is generally less than that of the nodule 33.

The grip 16 is graspable by a user or shooter for holding and selectively positioning the slingshot, and is constructed so as to permit user-imparted pivotal adjustment of the yoke 14 relative to the arm brace 18 for appropriate "aiming" of the projectile to be propelled. The grip 16 is formed as a pair of complementary grip sections 38, 40 which, when assembled, define an arcuately contoured surface shaped to comfortably conform to or otherwise accommodate a user's hand (FIG. 2). Each grip section includes a respective bottom section 42, 44, a respective contoured handle section 46, 48, and a respective top section 50, 52. The bottom sections 42, 44 and the top sections 50, 52 are of notably increased diametric extent relative to the grip sections 38, 40 for the dual functions of engagement with other components of the slingshot 10, as will hereinafter become apparent, and to prevent unintended vertical displacement of the user's hand as it grasps the slingshot 10 about the grip sections.

The arrangement for mounting of the yoke 14 to the grip 16 will now be described. With particular reference to FIG. 3, the two grip sections 46 and 48 are disposed in confronting relation so as to captively surround the lower member 31 and the nodule 33 of the yoke 14. In the illustrated embodiment of FIGS. 1 to 3, the sections 46, 48 are secured together by screws 53 which extend through apertures 61 in the grip section 46 and thoughbores 57 defined in the neck portion 32 and which engage annular sockets 55 on the grip section 48. Thus, pivotal movement of the grip 16 relative to the arm brace 18, as will hereinafter be described, carries the yoke 14 through a corresponding pivotal motion or adjustment.

As perhaps best seen in FIGS. 1 and 2, the arm brace 18—preferably fabricated as a single, unitary piece—is configured so as to provide a generally arcuate cuff 66 through which the forearm 100 of a user is insertable for positioning and stabilizing of the inventive slingshot 10. From the rearwardly-disposed cuff 66, the brace 18 extends forwardly along opposed frame extensions 68 that join and terminate in a disk-like head 54. The head 54, in turn, is captively received in a hollow 58 defined in each bottom section 42, 44 of the respective grip sections 38, 40, the hollows being predeterminately sized and configured to permit the intended limited pivotal rotation of the grip 16 relative to the captured head 54 of the arm brace 18. The cuff 66 and frame extensions 68 of the arm brace may further be provided with peripheral ribs 70 to impart added strength to the arm brace 18. The arm brace may be formed of a lightweight, inelastic material of appropriate tensile strength such, for example, as molded plastic.

The arm brace 18 may optionally be provided with the ability to carry or store one or more projectiles for use with the inventive slingshot 10. As for example seen in FIGS. 1 and 3, the cuff 66 includes a pair of outwardly projecting plates 72 for receiving therebetween a projectile 12. In the illustrated embodiment, where the projectile is of generally circular shape, a circular opening 74 may be defined in each plate 72 for accomodating the surface of the projectile and, in addition, a like opening or cutout 76 may be defined in the surface of the cuff 66 between the opposed plates 72. The plates may be fabricated as a unitary part of the cuff 66 or, alternatively, each pair of plates may comprise the arms of a rectangularly U-shaped member formed of a somewhat flexibly resilient material, the arms being receivable in projecting relation through slots 78 suitably defined in the cuff. A plurality of such slots and cutouts may be seen in the cuff of the slingshot embodiment of FIGS. 1 to 3. Thus, a projectile 10 is frictionally retainable between each pair of opposed plates 72 during periods of nonuse of the slingshot 10 or when that particular projectile is otherwise not in use.

As shown in FIG. 1, a projectile 12 in accordance with the invention and for use with the slingshot 10 is formed as a body 80—here depicted as a substantially round ball fabricated of a sponge-like, flexibly resilient material—from which integral elastic members or loops 84, 86 outwardly extend. The members 84, 86 are preferably sufficiently affixed or secured to the body 80 so as to be substantially nondetachable from the body during normal use of the projectile 12. Similarly, the engagement of the elastic members with the body should preferably substantially prevent unintended longitudinal shifting or displacement of the elastic members relative to the projectile body when the projectile is used in conjunction with the inventive slingshot. It is generally contemplated that the elastic members 84, 86 extend outwardly from substantially opposite sides or peripheral portions of the body 80, although alternative locations for the outward extension of the members from the body are also considered to be within the intended scope of the invention. The use of a relatively soft, sponge-like material enhances the safe use of the device although, as should be apparent, the projectile body 80 may be fabricated of any suitable material and take on any desired shape as general matters of design choice.

Figure 5A:
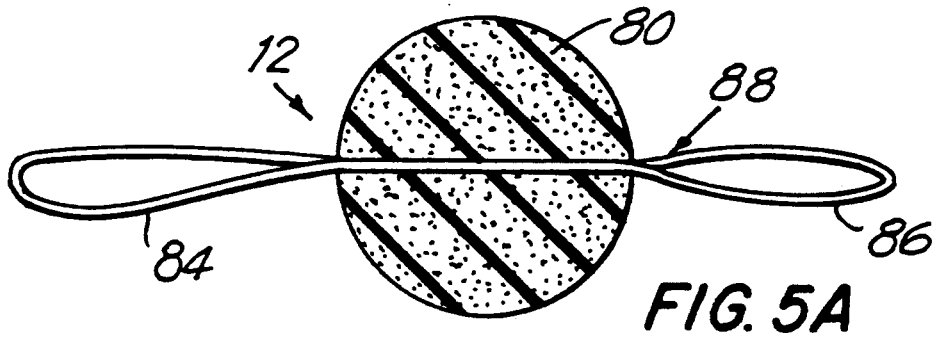
FIG. 5A is a cross-sectional view of a first embodiment of a projectile for use in conjunction with the slingshot device of the present invention.
Figure 5B:
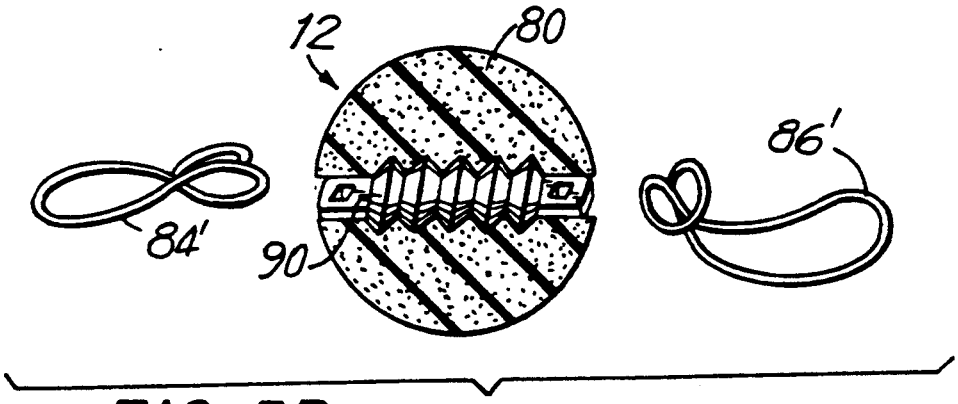
FIG. 5B is a cross-sectional view of a second embodiment of a projectile for use in conjunction with the slingshot device of the present invention.

Two currently-preferred constructions of such a projectile 12 are shown, by way of example, in FIGS. 5A and 5B of the drawings. In the projectile 12 of FIG. 5A, a bore is defined in and diametrically through the body 80 which, as indicated hereinabove, is fabricated of a resiliently-compressible sponge-like material. A single loop or band 88 of elastic wire or filamentary material is passed through the bore so that a loop of the material extends outwardly from each end of the bore at opposite sides of the body 80. It is intended that the bore be of such minimal diameter that the elastic filament 88 must be forced through it during assembly of the projectile, as by using a hook or other suitable tool, and so that the filament is then positionally held and retained within the projectile body 80 by the frictional compression of the body against the elastic filament at the peripheral wall of the bore. Longitudinal shifting of the filament 88 may be further discouraged by placing a loop or knot (not shown) in the filament at a position within the body 80.

The alternate projectile 12 depicted in FIG. 5B utilizes two separate loops or bands 84', 86' of elastic wire or filamentary material and a ribbed or threaded anchor 90. Here, again, a bore is defined in and diametrically through the projectile body 80, the bore in this instance being sized for receiving and frictionally retaining the anchor 90. The ribbing or threaded structure on the anchor is optional and enhances nondisplaceable retention of the anchor within the body. The anchor is dimensioned so as to be contained entirely within the periphery of the body 80 and is provided at each end with an aperture through which a respective one of the elastic bands 84', 86' is securely or fixedly looped or threaded. The resulting projectile 12 has the same general appearance as that resulting from the construction of FIG. 5A, both of which are broadly represented by the projectile 12 shown in FIGS. 1 to 4.

The intended operation and use of the slingshot 10 should now be apparent. Referring specifically to FIG. 2, the user's hand 102 and forearm 100 are inserted through the cuff 66 of the arm brace 18 and the grip 16 is grasped thereabout by the user's inserted hand. With the target in front of the user—i.e. to the right in FIG. 2—the loops of the elastic bands 84, 86 that extend from the projectile body 80 are placed about the respective posts 24, 26 so that the bands 84, 86 are releasably received in the respective slots 28, 30. Grasping the projectile body 80 with the other hand 104, the user then pulls or displaces the body rearwardly—i.e. away from the target—to resiliently stretch or extend the elastic members 84, 86 against their return urgency so as to place the members in tension and thereby store potential energy in the elastic bands. The yoke 14 is suitably pivoted relative to the arm brace 18 by the user to thereby aim the projectile toward the target, and the grasped and rearwardly displaced projectile is released. With such release, the elastic bands resiliently contract, converting their stored potential energy to kinetic energy and propelling the projectile 12 toward the target. As the projectile moves forwardly toward the target and passes through the yoke 12—i.e. between and beyond the nip defined between the prongs 20, 22—the elastic bands 84, 86 are pulled free of and automatically disengage from the slots 28, 30 of the posts 24, 26, thus remaining affixed to and travelling with the projectile body 80 as it advances toward the target.

In implementing the present invention, numerous variations and changes in the specific slingshot embodiment illustrated and described hereinabove may be provided without varying from the intended scope of the invention. For example, to simplify construction and reduce manufacturing costs, and to provide a more readily portable and easily-storable device, a second embodiment of a slingshot constructed in accordance with the present invention is depicted in FIG. 4. In effect, the slingshot 10' of FIG. 4 is much like the arrangement depicted in FIGS. 1 to 3 except that, as should be apparent, the FIG. 4 embodiment does not include an arm brace with respect to which the yoke is pivotably adjustable.

Thus, the slingshot 10' of FIG. 4 includes a yoke 14 configured in the manner of the yoke of the first-described embodiment of FIGS. 1 to 3 and, accordingly, having a pair of arms or prongs 20, 22 that extend upwardly and outwardly from a handgrip 16 from which the prongs integrally and, preferably, unitarily depend. The resulting structure has the general appearance of a large letter "Y", as is common in conventional slingshots. The yoke further includes a pair of posts 24, 26 having respective slots or grooves 28, 30, again in the manner of the embodiment of FIGS. 1 to 3. The handgrip 16, however, terminates at its lower end opposite the prongs 20, 22 in a diametrically-enlarged boss 106 to facilitate user grasping of the slingshot 10' about the handgrip and discourage unintended vertical displacement or slippage of the user's hand along the elongated handgrip. Thus, the slingshot 10' is constructed generally in the manner of the embodiment of FIGS. 1 to 3 except for the omission in the FIG. 4 embodiment of the accompanying arm brace to which the yoke is pivotally secured in the earlier-described embodiment. Similarly, modifications described hereinabove with respect to the first slingshot embodiment are equally applicable to the second, FIG. 4 form of the invention.

The operation and use of the slingshot 10' will be apparent from the description heretofore provided in respect of the first embodiment of the invention. In this case, however, the slingshot is simply grasped by one of the user's hands 102 about the handgrip 16, and the projectile 12 is grasped and drawn rearwardly by the user's other hand 104, as depicted in FIG. 4. Release of the projectile causes it to be propelled toward the target in the same manner as that previously described in respect of the embodiment of FIGS. 1 to 3.

It should accordingly be understood that the preferred embodiments and specific examples of modifications thereto which have been described are for illustrative purposes only and are not intended to be construed as limitations on the scope of the present invention. Thus, while there have been shown and described and pointed out fundamental novel features of the invention as applied to preferred embodiments thereof, it will be further understood that various omissions and substitutions and changes in the form and details of the devices illustrated and described, and in their operation, may be made by those skilled in the art without departing from the spirit of the invention. It is the intention, therefore, to be limited only as indicated by the scope of the claims appended hereto.

What is claimed is:

1. A slingshot device for propelling an object having first and second elastic members toward a target located in a first direction from said device, said slingshot device comprising:

a yoke comprising first and second substantially upwardly extending prongs; and a grip depending from said yoke for grasped retention by a user for holding said slingshot device;

each of said first and second prongs comprising means for releasably engaging a respective one of the first and second elastic members of the object, for retaining the respective elastic member as the object is grasped by a user and displaced relative to said grip in a second direction substantially opposite said first direction against the elastic urgency of the elastic members, and for disengaging the respective elastic member from said device when the grasped object is released by the user and thereby propelled by the urgency of the elastic members in said first direction toward the target.

2. A slingshot device according to claim 1, wherein said means comprises first and second members having respective first and second slotted surfaces arranged facing the target, said first and second members being respectively disposed on said first and second prongs, and said first and second slotted surfaces being configured for releasable engagement with the first and second elastic members of the object.

3. A slingshot device according to claim 1, further comprising an arm brace extending from said grip along substantially said second direction.

4. A slingshot device according to claim 3, wherein said grip is pivotally mounted to said arm brace.

5. A slingshot device according to claim 3, wherein said arm brace comprises means for storing the object during periods of nonuse of said device.

6. A slingshot device according to claim 1, wherein said means comprises a first member depending outwardly from said first prong and projecting substantially toward said second prong, and a second member depending outwardly from said second prong and projecting substantially toward said first prong, each of said first and second members having a slot defined in said member and open in substantially said first direction for releasable engagement with one of the first and second elastic members of the object.

7. A slingshot device for propelling an object having integral first and second elastic members toward a target located in a first direction from said device, said slingshot device comprising:

a yoke comprising first and second substantially upwardly extending prongs, said first and second prongs comprising respective first and second members extending in confronting relation to each other, each of said first and second members having a groove defined therein for releasable engagement with one of the first and second elastic members, and each said groove being open in substantially said first direction of the target; and a grip depending from said yoke for grasped retention by a user for holding said slingshot device.

8. A slingshot device according to claim 7, further comprising an arm brace extending rearwardly from said grip along a second direction substantially opposite said first direction.

9. A slingshot device according to claim 8, wherein said grip is pivotally mounted to said arm brace.

10. A slingshot device according to claim 8, wherein said arm brace comprises means for storing the object during periods of nonuse of said device.

11. A slingshot device according to claim 7, each of said first and second members comprising an elongated post extending outwardly from the respective prong toward the post of the other of said first and second prongs and having a surface portion substantially facing said first direction and in which said groove is defined.

12. A slingshot system comprising:

an object comprising an elastic means for elastically storing energy when said elastic means is placed in tension and for releasing the stored energy when the tension is released, said elastic means having first and second elastic portions; and a slingshot for propelling said object toward a target located in a first direction from said slingshot, said slingshot comprising:

a yoke comprising first and second substantially upwardly extending prongs; and a grip depending from said yoke for grasped retention by a user for holding said slingshot;

each of said first and second prongs comprising capture means (1) for releasably engaging a respective one of said first and second elastic portions of said object and for retaining the respective elastic portion as the object is grasped by the user and displaced relative to said grip in a second direction substantially opposite said first direction whereby said elastic means is placed in tension, and (2) for disengaging said respective elastic portion when said grasped object is released by the user to thereby propel said object in said first direction toward the target as the tension in said respective elastic member is released.

13. A slingshot system according to claim 12, wherein said capture means comprises first and second members having respective first and second slotted surfaces facing said first direction of the target and each depending from a respective one of said first and second prongs, and each of said first and second slotted surfaces being configured for releasable engagement with one of said first and second elastic portions of said object.

14. A slingshot system according to claim 13, each of said first and second members comprising an elongated post extending outwardly from the respective prong toward the post of the other of said first and second prongs, and each of said first and second slotted surfaces comprising a surface portion of a respective one of said posts, substantially facing said first direction and in which a slot is defined.

15. A slingshot system according to claim 13, wherein said object further comprises a body from which each of said first and second elastic portions integrally depends.

16. A slingshot system according to claim 15, wherein said body is formed of a resilient material.

17. A slingshot system according to claim 13, wherein said object further comprises a body, said first elastic portion of said elastic means comprises a first elastic member fixedly attached to and extending outwardly from said body, and said second elastic portion of said elastic means comprises a second elastic member fixedly attached to and extending outwardly from said body.

18. A slingshot system according to claim 17, wherein said first and second elastic members extend outwardly from said opposite sides of said body.

19. A slingshot system according to claim 13, wherein said object further comprises a body, said first elastic portion of said elastic means comprises a first elastic member extending outwardly from said body and said second elastic portion of said elastic means comprises a second elastic member extending outwardly from said body, and each of said first and second outwardly extending elastic members comprising a loop for releasable engagement about a respective one of said first and second members.

20. A slingshot system according to claim 12, further comprising an arm brace extending from said grip in substantially said second direction.

21. A slingshot system according to claim 20, wherein said grip is pivotally mounted to said arm brace.

22. A slingshot system according to claim 20, wherein said arm brace comprises means for storing said object during periods of nonuse of said slingshot system.

23. A slingshot system comprising:

an object having an elastic means for elastically storing energy when said elastic means is placed in tension and for propelling said object when the tension is released, said elastic means having first and second elastic portions; and a slingshot for projecting said object toward a target located in a first direction from said slingshot, said slingshot comprising:

a yoke comprising first and second substantially upwardly extending prongs, said first and second prongs comprising respective first and second members extending in confronting relation to each other, each of said first and second members having a groove defined therein for releasable engagement with one of said first and second elastic portions, and each said groove being open in substantially said first direction of said target; and a grip depending from said yoke for grasped retention by a user for holding said slingshot device.

24. A slingshot system according to claim 23, further comprising an arm brace extending from said grip along a second direction substantially opposite said first direction.

25. A slingshot system according to claim 24, wherein said grip is pivotally mounted to said arm brace.

26. A slingshot system according to claim 24, wherein said arm brace comprises means for storing said object during periods of nonuse of said slingshot system.

27. A slingshot system according to claim 23, each of said first and second members comprising an elongated post extending outwardly from the respective prong toward the post of the other of said first and second prongs and having a surface portion substantially facing said first direction and in which said groove is defined.

28. A slingshot system according to claim 23, wherein said object further comprises a body from which each of said first and second elastic portions integrally depends.

29. A slingshot system according to claim 28, wherein said body is formed of a resilient material.

30. A slingshot system according to claim 23, wherein said first elastic portion of said elastic means comprises a first elastic member fixedly attached to and extending outwardly from said body, and said second elastic portion of said elastic means comprises a second elastic member fixedly attached to and extending outwardly from said body.

31. A slingshot system according to claim 23, wherein said object further comprises a body and an aperture defined in and through said body, and said elastic means comprises a unitary elastic member tightly journalled through said aperture, said first elastic portion comprising a first end of said elastic member extending outwardly from said body and said second elastic portion comprising a second end of said elastic member extending outwardly from said body.

32. A slingshot system according to claim 23, wherein said object further comprises a body and securement means in said body for nondetachable connection to said first and second elastic portions so that said first and second elastic portions extend outwardly from said body for releasable engagement with said grooves of said first and second members.

33. A method for propelling an object having a body toward a target located in a first direction from a user, comprising the steps of:

maintaining a user-selected position of a slingshot having a yoke formed of first and second substantially upwardly extending prongs, the first and second prongs including respective first and second members extending outwardly from the prongs and a groove defined in each of the first and second members, and a grip depending from the yoke, by grasping of the grip by the user so that the target is located in the first direction from the slingshot and the grooves open in the first direction from the first and second members;

providing the object with first and second elastic members extending integrally and nondisengagingly from the body of the object;

releasably engaging the first and second elastic members with the grooves of the first and second members of the yoke;

grasping the body of the object and displacing the grasped object relative to the yoke in a second direction opposite the first direction of the target to thereby place the first and second elastic members in tension and thereby store an elastic energy in the elastic members; and releasing the grasped and displaced object to thereby release the stored elastic energy and propel the object and the integral elastic members in the first direction toward the target under the urgency of the elastic members.

* * * * *